United States Patent [19]

Yamagishi et al.

[11] 4,200,211

[45] Apr. 29, 1980

[54] WEB GUIDE DEVICE

[75] Inventors: Kiichiro Yamagishi; Matutaro Hirose; Sachio Muramatsu, all of Fujinomiya, Japan

[73] Assignee: Fuji Photo Film Co., Ltd., Minami-ashigara, Japan

[21] Appl. No.: 930,840

[22] Filed: Aug. 3, 1978

[30] Foreign Application Priority Data

Aug. 3, 1977 [JP] Japan ..... 52-93230

[51] Int. Cl.[2] ..... B65H 25/26; B65H 17/32

[52] U.S. Cl. ..... 226/21; 226/97; 242/57.1

[58] Field of Search ..... 226/21, 22, 23, 97; 242/57.1

[56] References Cited

U.S. PATENT DOCUMENTS

| | | | |
|---|---|---|---|
| 2,989,265 | 6/1961 | Selsted | 226/21 X |
| 3,664,561 | 5/1972 | Feiertag | 226/21 |
| 3,826,416 | 7/1974 | Takagi | 226/22 |

FOREIGN PATENT DOCUMENTS

| | | | |
|---|---|---|---|
| 2407842 | 8/1975 | Fed. Rep. of Germany | 226/21 |

*Primary Examiner*—Edward J. McCarthy

*Attorney, Agent, or Firm*—Sughrue, Rothwell, Mion, Zinn and Macpeak

[57] ABSTRACT

A control roller for controlling the lateral position of a moving web is pivotable about an axis perpendicular to the web surface immediately upstream of the control roller. In the preferred embodiment, the two ends of a plate on which the roller is mounted are slidably supported on shafts tangent to a circle having the pivoting axis as its center.

3 Claims, 4 Drawing Figures

WEB GUIDE DEVICE

BACKGROUND OF THE INVENTION

This invention relates to web guide devices which control the lateral position of a web, which web is continuously carried in the longitudinal direction thereof, and, more particularly, to a web guide device employable in a web carrying line having a means for floatingly supporting the web by fluid cushion and a means for supporting the web directly on a solid surface, such as that of a roller.

The term "web" as used herein is intended to mean a belt-shaped material which is relatively flexible and somewhat rigid and is, generally, 5μ–1000 μ in thickness and 0.3 m–5 m in width, and which is made of plastics, such as polyethylene terephthalate, polypropylene, cellulose triacetate, vinyl polychloride, polycarbonate, etc., or metals, such as aluminum, copper, etc., papers, such as machine-made paper, synthetic paper, etc., or fabric, such as non-woven fabric. Depending on the intended use, the belt-shaped material may be covered with a film.

In web carrying lines which carry a web continuously in its longitudinal direction, it is often necessary to carry the web without causing the surface of the web to touch any of the solid surfaces, such as those of a pass roller, a drum, and canvas felt. In order to meet this requirement, a variety of means have been put into use in which a web is floatingly supported by utilizing a fluid cushion system in which a pressurized fluid, such as air or nitrogen gas, is jetted towards the surface of the web.

It is possible, with the proper arrangement of chambers adapted to jet the pressurized fluid, for the above-described fluid cushion supporting means to floatingly support the web along a web path in the form of an arch or a zigzag line extended in the longitudinal direction of the web. In this case, the frictional force in the lateral direction of the web supported by the floating support means is considerably smaller than that of the web supported directly by a solid support means. Accordingly, because of the lateral elongation of the web, the uneven web tension distribution in the lateral direction, and the uneven fluid cushion pressure in the lateral direction, the web is liable to laterally displace, while the web floating height is also liable to become uneven, and, therefore, a web supporting surface much wider than the width of the web is necessary. At worst, the web is brought into contact with the solid surfaces of the chambers or is greatly shifted from its predetermined running position, which stops the web from running.

In order to eliminate the above-described difficulties, a web guide device as disclosed in U.S. Pat. No. 3,826,416 has been provided, in which a web which has passed through the fluid cushion support means is brought into contact with the solid surface of a control roller to thereby turn the running direction of the web, and the control roller is swung around an axis perpendicular to the surface of the web whose running direction has been turned to thereby exert a higher tension on one of the edges of the web; that is, the web is displaced toward the edge having the higher tension in accordance with well-known principles to thereby correct the positional deviation of the web in the lateral direction.

The above-described web guide device can quickly control the position of the web in the fluid cushion support means with high accuracy, which otherwise is liable to be shifted in the lateral direction, and this contributes considerably to the improvement of the web carrying efficiency and characteristics.

There are a variety of different webs which are to be carried by the web carrying line. For instance, if the thickness of a web is relatively thin—that is, the web is relatively deformable—the formation of creases or wrinkles which may permanently deform the web and the tear of the margin of the web are frequently caused by the control roller of a conventional web guide device.

In addition, if the pressure sensitivity of the film provided on the web is high, the quality of the film in the vicinity of one of the edges of the web which is brought into contact with the control roller is considerably lowered.

As a result of investigation and analysis on the causes of the above-described difficulties, the inventors have found that a web tension distribution extremely biased toward one edge of the web is caused is generated by the above described swing action of the conventional roller system, and, therefore, the web is slidingly displaced on the surface of the control roller toward the web edge where the tension is higher. This occurs at a relatively high speed, as a result of which a web having a high rigidity is liable to crease and, especially in the vicinity of the edge where the highest tension is provided, cutting of the margin and breaking of the web are liable to occur. Furthermore, the film may also be broken by the pressure.

As a result of various studies and experiments on the control roller, the inventors have invented and put into use a novel web guide device.

SUMMARY OF THE INVENTION

Accordingly, it is an object of the invention to provide a web guide device in which the above-described drawbacks accompanying a conventional web guide device have been eliminated, and the lateral position of even a relatively thin web having a high pressure sensitivity, which is liable to be deformed while running through the fluid cushion supporting means, can be satisfactorily corrected with high accuracy.

The foregoing and other objects of the invention can be achieved by providing a web guide device which comprises a control roller which serves as the first roller in a solid supporting means provided downstream of a floating support means, the first roller being brought substantially into contact with the web, the control roller capable of swinging around a swing center axis set perpendicular or substantially perpendicular to the surface of the web located just in the upstream of the control roller, and the control roller operates to simultaneously displace the web in the lateral direction and vary the feeding-in angle of the web with respect to the control roller to thereby control the lateral position of the web.

BRIEF DESCRIPTION OF THE DRAWINGS

This invention will now be described with reference to the accompanying drawings, in which.

DETAILED DESCRIPTION OF THE INVENTION

Figure 1:
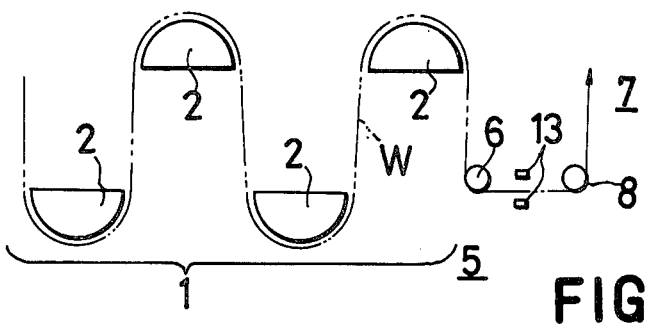
FIG. 1 is a side view showing a web guide device according to the invention and a web carrying line in which the web guide device is employed.
Figure 2:
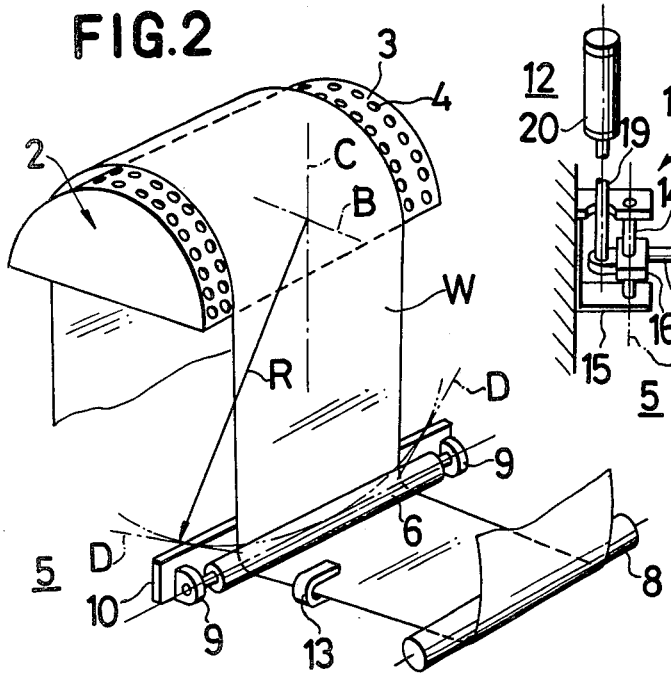
FIG. 2 is a perspective view showing the web guide device according to the invention.
Figure 3:
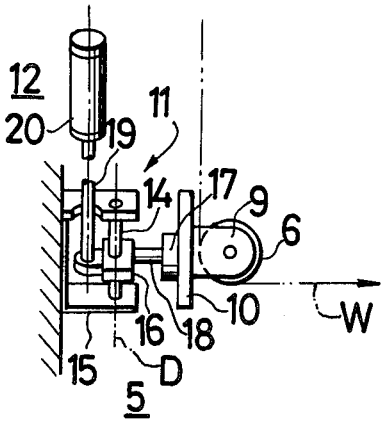
FIG. 3 is a side view showing one swing guide means and a swing drive means employed in the web guide device according to the invention.

Referring to FIGS. 1–3, a web is carried in the direction of the arrow A while being floatingly supported by a floating support means 1 in such a manner that the web is not in contact with solid surfaces. The floating support means 1 comprises a plurality of chambers 2, each of which has a web supporting surface 3 serving to jet pressurized fluid, such as air or nitrogen gas, toward the surface of the web W. The chambers 2 are disposed in such a manner that they are alternately shifted, or staggered, vertically with respect to one another.

The web support surface 3 of the chamber 2 has a number of small pressurized fluid jetting holes 4 which are arranged over a width which is wider than the width of the web W so that even if the web W is displaced in the direction of its width to some extent, the web W can be floatingly supported by the fluid cushion.

After passing over the last chamber 2 of the floating support means 1, one surface of the web W is brought into contact with a control roller 6 forming a part of a web guide device 5 according to the present invention, as a result of which the web W is guided substantially downwardly from the last chamber 2. The web W then passes over the control roller 6 at a contact angle of about 90° and advances towards the first pass roller 8 of a solid support means 7 comprising a number of pass rollers (not shown). The web W thus brought into contact with the first pass roller 8 is thereafter supported by the pass rollers of the solid support means 7 and is forwarded in a desired direction.

With the above construction, the control roller 6 serves as the first roller of the solid support means 7 to contact and support the web W, while the primary object of the first pass roller 8 is to maintain the aforementioned contact angle or frictional force so as to permit the control roller 6 to effectively act on the web W.

The web guide device 5 comprises a pair of bearings 9 which rotatably support the control roller 6; a common support plate 10 supporting the bearings 9; swing guide means 11 which are provided at the two end portions of the surface of the support plate 10, which surface is opposite to the surface where the bearings 9 are provided, the swing guide means 11 operating to guide the common support plate 10 and the control roller 6 so that they can swing around a phantom center axis B which is perpendicular or substantially perpendicular to the web W just in the upstream of the control roller 6; swing drive means 12 adapted to swing the common support plate 10 and the control roller 6 through the swing guide means 11; a sensor 13 disposed between the control roller 6 and the first pass roller 8 and closer to the control roller 6 to detect the position of an edge of the web W; and a control system (not shown) for suitably operating the swing drive means 12 in response to the detection signal of the sensor 13.

The swing guide means 11 and the swing drive means 12 will now be described in more detail.

The two swing guide means 11 at either end of the plate 10 are identical and only one need be described. In the swing guide means 11, in order to swing the common support plate 10 and the control roller 6 around the phantom swing center axis B with a predetermined radius R, a guide shaft 14 is arranged along a shaft axis D perpendicular to the radius R on a stationary stand 15, and a slider 16 mounted on the guide shaft 14 is coupled to the rear end portion of a horizontal shaft 18. The shaft 18 is rotatably supported by a bearing 17 which is provided on the common support plate 10 so as to confront the bearing 9 through the common support plate 10.

On the other hand, the swing drive means 12 has a reciprocating-type oil pressure cylinder for controlling a rod, the end of which is coupled to the slider 16, so as to reciprocate the slide 16 along the guide shaft 14 in response to the control signal outputted by the control system.

After the running direction of the web W has been changed through approximately 90° by means of the control roller 6, the lateral position of the web is continuously detected by the sensor 13 disposed just on the downstream side of the control roller 6.

When the web W is laterally shifted, or displaced, in the floating support means 1, the web W runs while varying its feeding-in and feeding-out angles with respect to the control roller 6, and, therefore, the direction and amount of the displacement are immediately detected by the sensor 13. Consequently, the reciprocating-type oil pressure cylinder 20 is operated by the control signal on the basis of the detection signal outputted by the sensor 13. As the rod 19 of the oil pressure cylinder 20 is protruded or retracted, the slide is caused to slide along the guide shaft 14 in response to the movement of the rod 19. As a result, the straight motion of the slider 16 being guided by the guide shaft 14 is transmitted to the horizontal shaft 18.

When the straight motion of the slider 16 is transmitted to the horizontal shaft 18, the horizontal shaft 18 moves the two end portions of the common support plate 10 along the shaft axis D of the guide shaft 14 and simultaneously turns them around the vertical shaft 18; that is, the common support plate 10 and the control roller 6 are turned in one direction around the phantom swing center line B while describing an arc. In this case, the length of the radius R is somewhat varied according to the distance of swing, while the arc can be regarded as constant because the amount of variation thereof is much smaller than that of the radius R. When the control roller 6 is turned in one direction as was described above, the web W, being in contact with the control roller 6 with a contact angle of about 90°, is moved laterally in a direction opposite to the direction in which it was displaced in the floating support means 1 until the feeding-in angle is restored to normal.

In general, the swing distance of the control roller 6 required to correct the lateral displacement of the web W is much smaller than the width of the web W. Therefore, even if the control roller 6 is swung, a considerably non-uniform tension distribution will not occur in the lateral direction of the web W.

Accordingly, the web W is swung while being supported by the control roller 6 and is prevented from being brought into contact with the surface of the control roller 6 under an extraordinarily high pressure. As a result, highly pressure-sensitive film on the web will not be damaged at all, and tearing the margin and breaking the web itself can be prevented. Thus, the web can leave the control roller 6 without being damaged at all.

Unlike the conventional device in which a web W is shifted on the surface of the roller in its axial direction by utilization of a non-uniform tension distribution, the control roller 6 operates to set the web W into a predetermined position while maintaining the tension distribution substantially uniform. Accordingly, the swinging operation of the control roller 6 can prevent the floating height of the web W in the floating support means 1 from becoming non-uniform and can also prevent the wrinkles which permanently distort the web and normally take place in the vicinity of the control roller 6.

If the distance between the first pass roller 8 and the control roller 6 is set to more than half, and preferably more than half, of the width of the web W, the occurrence of wrinkles at the control roller 6 and in the vicinity thereof can be more positively prevented, and, in addition, it is possible to increase the allowable swing angle of the control roller 6.

The sensor 13 may be of the aero-electrical type or of the opto-electrical type if it is a contact-less type. Furthermore, the sensor 13 may be disposed on the upstream side of the control roller 6 if the position is close to the control roller 6.

Each of the reciprocating-type oil pressure cylinders 20 selects its power according to the sliding resistance of the guide shaft 14 and the slider 16 and to the tension of the web W. Although the reciprocating-type oil pressure cylinders 20 are provided for each of the swing guide means 11 in the embodiment described above, the web guide device may be so designed that one oil pressure cylinder 20 is provided for only one of the swing guide means 11. Furthermore, instead of the reciprocating-type oil pressure cylinder 2, a reciprocating-type air pressure cylinder or an electric motor, such as a print motor, may be employed.

It should be noted that the contact angle of the web W with respect to the control roller 6 is not always limited to 90°. However, it is recommended that the contact angle is set to an angle range of from 60° to 120°, and preferably to approximately 90°, in order to prevent the occurrence of abrasion or wrinkles in the web which may be caused by an improper contact angle.

If the phantom swing center axis B is set so as to be perpendicular or substantially perpendicular to the surface of the web W on the upstream side of the control roller 6, and to be in parallel to the surface of the web W on the downstream side of the control roller 6 (that is, if the contact angle is set to 90°), then the web tension distribution is made stabler and more uniform during swinging of the control roller 6.

It is desirable that the phantom swing center line B coincides with the center line C of the web carrying line; however, in practice, the deviation of the phantom swing center axis B from the center line C can be sufficiently corrected by changing the lateral position of the sensor 13.

The above-described swing center axis B is not always limited to the phantom on shown. That is, if there is a sufficient space, the following method may be employed. A real swing center shaft B is provided, and the control roller 6 is coupled to the real swing center shaft B by means of a supporting rod or the like to thereby swing the control roller 6.

In the above-described embodiment, only one control roller 6 is employed; however, the invention is not limited thereto or thereby. That is, it is possible to provide a plurality of control rollers 6 in such a manner that they are swung around one and the same swing center axis B.

The web guide device according to the invention has been described with reference to the case in which after the web W has passed through the floating support means 1, it is guided substantially downwardly. However, it is possible to change the web guide direction with respect to the position of the solid support means 7 provided downstream of the floating support means 1 as long as the proper contact angle on control roller 6 is maintained. For instance, the web path may be formed in such a manner that the control roller 6 is provided above, rather than below, the floating support means 1, the lateral displacement of the web can be corrected while the web W is being guided upwardly, and then the web may be returned to a suitable position below.

Figure 4:
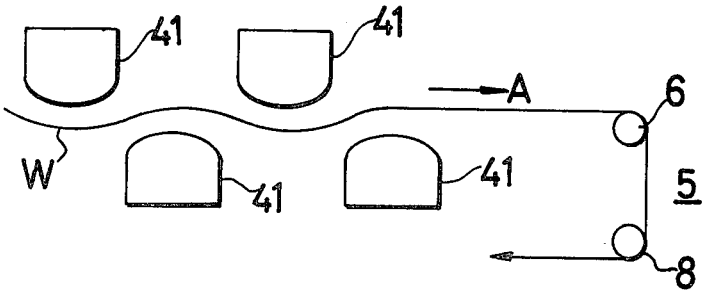
FIG. 4 is a side view illustrating another application of the web guide device according to the invention.

Furthermore, as shown in FIG. 4, even downstream of floating support means 41, which are adapted to support the web W in a somewhat staggered manner in which the running direction of the web W is not completely alternately reversed, it is possible to control the web W to a predetermined lateral position with the web guide device according to the invention.

The web guide device according to the invention has the following novel effects:

1. The control roller 6 swings around the swing center line B set so as to be perpendicular to the surface of the web W on the upstream side of the control roller 6, as a result of which the web W is brought to the predetermined lateral position without causing a tension distribution which is biased in the lateral direction of the web W. Therefore, it is possible to protect a web W from unwanted wrinkle formation, marginal tear, breakage, or the damage of the film due to extraordinary high pressure by covering it with a deformable or highly pressure-sensitive film. Thus, the web W can be stably carried along the web carrying line.

2. Even while the control roller 6 is swinging, the control roller 6 can bring the web W on the upstream side of the control roller to a predetermined lateral position without causing a laterally biased tension distribution. Therefore, lateral displacement of the web W in the floating support means 1 can be quickly corrected with high accuracy, and, in addition, the web's floating height can be maintained uniform at all times.

3. The control roller 6 causes the web W to change its feeding-in angle and to laterally displace while contacting with the first roller which is substantially brought into contact with the web W to thereby control the lateral position of the web. Therefore, the construction of the web guide device can be made relatively simple, and, accordingly, the web guide device according to the invention can be installed in a web carrying line which is relatively intricate and has little extra space.

What is claimed is:

1. In a web guide device for controlling the lateral position of a web in a web carrying line including a floating support means for floatingly supporting a web by a fluid cushion, and a solid support means downstream of said floating support means for supporting the web directly on a solid surface, such as that of a pass roller, the improvement comprising control roller means disposed between said floating and solid support means and downstream of said floating support means, said control roller means being brought substantially into contact with said web and being capable of swinging around a swing center line set substantially perpendicular to the surface of said web upstream of said control roller means, said swing center line located substantially directly above said control roller means and substantially coinciding with the center line of the web, said control roller means operating to laterally displace said web while simultaneously varying the feeding-in angle of said web with respect to said control roller means to thereby control the lateral position of said web.

2. A web guide device as defined in claim 1 wherein the distance between said control roller means and said solid support means located downstream of said control roller means is at least half of the width of said web.

3. A web guide device as defined in claim 1 or 2 wherein said control roller means supports and guides said web with a contact angle in the range of from 60° to 120°.

* * * * *